United States Patent [19]

Shuto et al.

[11] Patent Number: 4,608,334

[45] Date of Patent: Aug. 26, 1986

[54] SILVER HALIDE COLOR LIGHT-SENSITIVE MATERIAL

[75] Inventors: Sadanobu Shuto; Munehisa Fujita; Kazunori Hasebe, all of Kanagawa, Japan

[73] Assignee: Fuji Photo Film Co., Ltd., Kanagawa, Japan

[21] Appl. No.: 775,941

[22] Filed: Sep. 12, 1985

Related U.S. Application Data

[63] Continuation-in-part of Ser. No. 681,740, Dec. 14, 1984, abandoned.

[30] Foreign Application Priority Data

Dec. 19, 1983 [JP] Japan ..... 58-239284

[51] Int. Cl.[4] ..... G03C 1/46; G03C 1/08

[52] U.S. Cl. ..... 430/505; 430/506; 430/509

[58] Field of Search ..... 430/505, 506, 509

[56] References Cited

U.S. PATENT DOCUMENTS

| | | | |
|---|---|---|---|
| 4,129,446 | 12/1978 | Lohmann et al. | 430/506 |
| 4,170,479 | 10/1979 | Usami | 430/509 |
| 4,414,308 | 11/1983 | Hamada | 430/505 |
| 4,438,194 | 3/1984 | Hamada | 430/506 |

*Primary Examiner*—Mary F. Downey

*Attorney, Agent, or Firm*—Sughrue, Mion, Zinn, Macpeak & Seas

[57] ABSTRACT

A silver halide color light-sensitive material having improved graininess is described, comprising a support having provided thereon at least two emulsion layers that are sensitive to the same color light but have different sensitivities, wherein a light-insensitive intermediate layer comprising gelatin is provided between any two of said emulsion layers that are adjacent to each other and the higher sensitivity emulsion layer of said two layers has a smaller silver/coupler molar ratio than that of the lower sensitivity emulsion layer of said two emulsion layers.

19 Claims, No Drawings

SILVER HALIDE COLOR LIGHT-SENSITIVE MATERIAL

This a continuation-in-part of application Ser. No. 681,740 filed Dec. 14, 1984, abandoned.

FIELD OF THE INVENTION

This invention relates to a silver halide color light-sensitive material having improved graininess, and, more particularly, to a silver halide color reversal light-sensitive material having improved graininess.

BACKGROUND OF THE INVENTION

Various techniques for improving graininess of dye images of silver halide color light-sensitive materials are hitherto known. For example, Japanese Patent Publication No. 15495/74 discloses a technique wherein an intermediate layer containing gelatin is provided between a high sensitivity emulsion layer and a low sensitivity emulsion layer for the purpose of preventing influences of coarse grains in the high sensitivity emulsion layer. Further, U.S. Pat. No. 4,414,308 discloses a technique wherein an intermediate layer comprising light-insensitive gelatin containing a coupler, which develops the same hue as that developed by a coupler contained in a high sensitivity emulsion layer and has a coupling rate not higher than that of said coupler in the high sensitivity emulsion layer, is provided between the high sensitivity emulsion layer and the low sensitivity emulsion layer.

All of the light-sensitive materials employing these techniques are negative photographic materials that are subjected to negative processing and intended to be printed on positive materials such as print paper. Negative photographic materials generally have a layer structure in which the silver/coupler molar ratio in a high sensitivity emulsion layer is larger than that in a low sensitivity emulsion layer. However, there has been no consideration in the art of techniques applicable to a layer structure in which the silver/coupler molar ratio in a high sensitivity emulsion layer is smaller than that in a low sensitivity emulsion layer, which is usually employed in color reversal light-sensitive materials. Improvement of graininess by providing an intermediate layer as described above is possible only in the above-described layer structure employed in negative photographic materials because an oxidation product of a developing agent diffuses from the high sensitivity emulsion layer having larger grains into the low sensitivity emulsion layer due to the larger silver/coupler ratio of the high sensitivity emulsion layer and develops a color therein, thereby reducing graininess of the low sensitivity emulsion layer.

In color reversal light-sensitive materials, however, the silver/coupler ratio in a high sensitivity emulsion layer is generally smaller than that in a low sensitivity emulsion layer, so that the diffusion of an oxidation product of a developing agent takes place in the reverse direction to the case of the negative photographic materials, i.e., the oxidation product of a developing agent diffuses from the low sensitivity emulsion layer having a smaller grain size into the high sensitivity emulsion layer of poor graininess. Accordingly, a reduction of graininess due to diffusion of an oxidation product of a developing agent does not occur in the color reversal light-sensitive materials. Thus, a color reversal light-sensitive material having an intermediate layer between a high sensitivity emulsion layer and a low sensitivity emulsion layer has not hitherto been proposed.

However, the graininess of color reversal light-sensitive materials is still unsatisfactory, and further improvement in graininess is highly desired.

SUMMARY OF THE INVENTION

Accordingly, an object of this invention is to improve graininess of a silver halide light-sensitive material wherein a silver/coupler molar ratio of a high sensitivity emulsion layer is smaller than that of a low sensitivity emulsion layer.

Another object of this invention is to provide a color reversal light-sensitive material having improved graininess, particularly in the practically important density region.

These objects of the present invention are accomplished by a silver halide color light-sensitive material comprising a support having provided thereon at least two emulsion layers that are sensitive to the same color light but have different sensitivities, wherein a light-insensitive intermediate layer containing gelatin is interposed between any two of said emulsion layers that are adjacent to each other, and the higher sensitivity emulsion layer of said two emulsion layers has a smaller silver/coupler molar ratio than that of the lower sensitivity emulsion layer of said two emulsion layers.

DETAILED DESCRIPTION OF THE INVENTION

The thickness of the gelatin-containing light-insensitive intermediate layer varies depending on the silver/coupler molar ratios of the two layers having the intermediate layer therebetween and other conditions. Usually, the thickness of the intermediate layer is at least 0.1 μm, preferably from 0.1 to 3 μm, and more preferably from 0.3 to 1.5 μm, to exert the effects of the present invention.

The objects of the present invention can be achieved provided that the silver/coupler ratio of the higher sensitivity emulsion layer is smaller than that of the lower sensitivity emulsion layer, but it is preferable that the silver/coupler ratio of the lower sensitivity emulsion layer is greater than that of the higher sensitivity emulsion layer by a factor of 1.2 or more, and more preferably 1.4 or more.

A preferred silver/coupler molar ratio of the higher sensitivity emulsion layer is from 2/1 to 20/1, and more preferably from 4/1 to 15/1. A suitable silver/coupler ratio of the lower sensitivity emulsion layer is 4/1 or more. The upper limit of the latter silver/coupler ratio is not particularly limited, but a preferred range is from 8/1 to 100/1.

Improvement in graininess by providing an intermediate layer is entirely unexpected in the light-sensitive materials having a layer structure according to the present invention.

It is primarily in a middle to low density region (i.e., a region having an optical density of 1.5 or less) that the improvement in graininess can be brought about by the present invention. This density region is most important from the viewpoint of practical use, and, therefore, the effects of the present invention are of great significance.

The above-described effect of the present invention asserts itself on emulsion layer groups having any color sensitivity, but it is preferable that the emulsion layer groups have blue sensitivity, green sensitivity or red sensitivity. The support may have provided thereon all of these three emulsion layer groups.

Each of the blue-sensitive, green-sensitive and red-sensitive emulsion layers can contain various couplers, but it is generally preferable to incorporate yellow-forming couplers in blue-sensitive emulsion layers, magenta color-forming couplers in green-sensitive emulsion layers, and cyan color-forming couplers in red-sensitive emulsion layers. Other combinations may be employed, if desired.

The color-forming couplers which can be used in the present invention, i.e., compounds capable of forming a color upon oxidative coupling with aromatic primary amine developing agents (e.g., phenylenediamine derivatives, aminophenol derivatives, etc.) in color development processing, include magenta couplers, such as 5-pyrazolone couplers, pyrazolobenzimidazole couplers, cyanoacetylcoumarone couplers, open-chain acylacetonitrile couplers, pyrazolotriazole couplers, pyrazoloimidazole couplers, pyrazolopyrazole couplers, pyrazolotetrazole couplers, etc.; yellow couplers, such as acylacetamide couplers (e.g., benzoyl acetanilides, pivaloyl acetanilides, etc.), etc.; and cyan couplers, such as naphthol couplers, phenol couplers, etc. Couplers having a hydrophobic group called ballast group in their molecules and being thereby rendered nondiffusible, or polymer couplers are preferable. The couplers may be either 2-equivalent or 4-equivalent with respect to silver ions. Further, colored couplers having an effect of color correction or couplers capable of releasing a development inhibitor with the progress of development (the so-called DIR couplers) can also be used.

In addition to DIR couplers, colorless coupling compounds which produce colorless coupling product and release a development inhibitor may also be used in the present invention.

Further, compounds capable of releasing a development inhibitor with the progress of development may also be used in addition to the DIR couplers.

Two or more of these couplers or like compounds may be contained in the same layer; or the same compound may be incorporated in two or more different layers in order to meet characteristics required for light-sensitive materials.

The photographic color-forming compounds can advantageously be selected so as to provide an intermediate scale image. It is preferable that maximum absorption bands of cyan dyes formed by cyan forming compounds; magenta dyes formed by magenta forming compounds; and yellow dyes formed by yellow forming compounds are in the ranges of from about 600 to 720 nm, about 500 to 580 nm, and about 400 to 480 nm, respectively.

Couplers can be incorporated in the silver halide emulsion layers of the present invention according to known methods, such as the method disclosed in U.S. Pat. No. 2,322,027. For example, the couplers are dissolved in a solvent and the solution is dispersed in a hydrophilic colloid. Solvents which can be used include high boiling solvents, such as alkyl phthalates (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric esters (e.g., tributyl acetylcitrate, etc.), benzoic esters (e.g., octyl benzoate, etc.), alkylamides (e.g., diethyllaurylamide, etc.), fatty acid esters (e.g., dibutoxyethyl succinate, diethyl azelate, etc.), trimesic esters (e.g., tributyl trimesate, etc.) and the like, and low boiling solvents having boiling points of about 30° to 150° C., such as lower alkyl acetates (e.g., ethyl acetate, butyl acetate, etc.), ethyl propionate, sec-butyl alcohol, methyl isobutyl ketone, β-ethoxyethyl acetate, methyl cellosolve acetate and the like. Mixtures of the above-described high boiling solvents and low boiling solvents may also be used.

For the incorporation of the coupler, a dispersion method using a polymer as described in Japanese Patent Publication No. 39853/76 and Japanese Patent Application (OPI) No. 59943/76 can also be used (the term "OPI" as used herein refers to a "published unexamined Japanese patent application").

When the coupler has an acid group such as a carboxyl group and a sulfo group, the coupler is introduced into a hydrophilic colloid as an alkaline aqueous solution.

Binders or protective colloids which can be used to advantage in the emulsion layers or intermediate layers of the light-sensitive materials of the present invention include conventional gelatins. Other conventional hydrophilic colloids can also be employed.

Examples of suitable hydrophilic colloids other than gelatin include proteins such as gelatin derivatives, graft polymers obtained by grafting other high polymers onto gelatin, albumin, casein, etc.; cellulose derivatives such as hydroxyethyl cellulose, carboxymethyl cellulose, cellulose sulfates, etc.; sugar derivatives such as sodium alginate, starch derivatives, etc.; and a wide variety of synthetic hydrophilic high molecular weight substances such as homo- or copolymers, e.g., polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, etc.

The gelatins which can be used include not only lime-processed gelatin but also acid-processed gelatin, enzyme-processed gelatin as described in *Bull. Soc. Sci. Phos. Japan,* No. 16, p. 30 (1966) as well as hydrolysis products and enzymatical decomposition products of gelatin.

Silver halides which can be used in the photographic emulsion layers of the photographic light-sensitive materials employed in the present invention include silver bromide, silver iodobromide, silver iodochlorobromide, silver chlorobromide and silver chloride. Preferred silver halides are silver iodobromide containing not more than 15 mol% of silver iodide. Especially preferred are silver iodobromides containing from 2 to 12 mol% of silver iodide.

The mean grain size of silver halide grains in the photographic emulsions (the grain size being defined as grain diameter if the grain has a spherical or a nearly spherical form and as a length of the edge if the grain has a cubic form, and being averaged based on the projected areas of the grains) is not particularly restricted, but is preferably 3 μm or less.

Grain size distribution may be either narrow or broad.

Silver halide grains in the photographic emulsion may have a regular crystal form such as s cube and an octahedron, an irregular crystal form such as a sphere and a plate, or a composite form thereof. Further, silver halide grains may be a mixture of grains having various crystal forms.

Furthermore, a silver halide emulsion wherein plate silver halide grains having a mean aspect ratio (i.e., diameter/thickness) of 5 or more occupy 50% or more of the total projected area of the total grains may also be employed.

The individual silver halide grains may comprise a core and an outer shell or may be homogeneous. Further, they may have a surface where a latent image has been formed to an appreciable extent, or may be those wherein a latent image is predominantly formed in the interior thereof.

Photographic emulsions employed in the present invention can be prepared according to conventional methods, e.g., as described in P. Glafkides, *Chemie et Physique Photographique*, Paul Montel, Paris (1967), G. F. Duffin, *Photographic Emulsion Chemistry*, The Focal Press, London (1966), V. L. Zelikman et al., *Making and Coating Photographic Emulsion*, The Focal Press, London (1964), etc. That is, the photographic emulsions can be prepared according to any of the acid process, the neutral process, the ammonia process and the like. Methods for reacting a water-soluble silver salt with a water-soluble halide include a single jet method, a double jet method, a combination thereof, and the like.

In addition, a method in which silver halide grains are produced in the presence of excess silver ions (the so-called reverse mixing method) can also be employed. Further, the so-called controlled double jet method, in which the pAg of the liquid phase wherein silver halide grains are to be precipitated is maintained constant, may be employed. According to this method, silver halide emulsions in which grains have a regular crystal form and an almost uniform size distribution can be obtained.

Two or more silver halide emulsions prepared separately may be used in the form of a mixture.

In a process for forming silver halide grains or allowing the formed silver halide grains to ripen physically, cadmium salts, zinc salts, lead salts, thallium salts, iridium salts or complexes thereof, rhodium salts or complexes thereof, iron salts or complexes thereof and the like may be present.

After the formation of silver halide grains or physical ripening of the grains, soluble salts are generally removed by the conventionally known noodle washing method comprising gelling the gelatin or a sedimentation method using an inorganic salt composed of a polyvalent anion (e.g., sodium sulfate), an anionic surface active agent, an anionic polymer (e.g., polystyrenesulfonic acid) or a gelatin derivative (e.g., gelatin substituted with an aliphatic acyl group or an aromatic acyl group, gelatin substituted with an aromatic carbamoyl, etc.).

The silver halide emulsions are usually subjected to chemical sensitization. Chemical sensitization can be conventionally carried out, for example, by the process described in H. Frieser, *Die Grundlagen der Photographischen Prozesse mit Silberhalogeniden*, pp. 675–734, Akademische Verlagsgesellschaft (1968).

More specifically, chemical sensitization can be carried out by sulfur sensitization using compounds containing sulfur capable of reacting with active gelatin or silver ions (e.g., thiosulfates, thioureas, mercapto compounds, rhodanines, etc.); reduction sensitization using reducing materials (e.g., stannous salts, amines, hydrazine derivatives, formamidinesulfinic acids, silane compounds, etc.); noble metal sensitization using noble metal compounds (e.g., gold complexes, and complexes of Periodic Table Group VIII metals such as Pt, Ir, Pd, etc.); or combinations thereof.

The photographic emulsions which can be used in the present invention can contain various compounds for the purpose of preventing fog in preparation, storage or photographic processing or for stabilizing photographic properties. Such compounds include azoles such as benzothiazolium salts, nitroimidazoles, nitrobenzimidazoles, chlorobenzimidazoles, bromobenzimidazoles, mercaptothiazoles, mercaptobenzothiazoles, mercapto-benzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione; azaindenes such as triazaindenes, tetraazaindenes (particularly 4-hydroxy-substituted (1,3,3a,7)tetraazaindenes), pentaazaindenes, etc.; and many other compounds known as antifoggants or stabilizers such as benzenethiosulfonic acid, benzenesulfinic acid, benzenesulfonic acid amide, etc.

The photographic emulsions or other hydrophilic colloidal layers of the light-sensitive materials of the present invention may contain various surface active agents for a wide variety of purposes including assistance of coating, prevention of static charge, improvement in slipping property, assistance of emulsifying dispersion, prevention of adhesion, improvement in photographic characteristics (e.g., acceleration of development, increase in contrast and sensitivity, etc.) and the like.

Specific examples of surface active agents which can be used include nonionic surface active agents such as saponin (steroid type), alkylene oxide derivatives (e.g., polyethylene glycol, polyethylene glycol/polypropylene glycol condensates, polyethylene glycol alkyl ethers or alkyl aryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic polyglycerides, alkylphenol polyglycerides, etc.), fatty acid esters of polyhydric alcohols, alkyl esters of sugars, and the like; anionic surface active agents containing acidic groups such as carboxyl, sulfo, phospho, sulfuric ester, phosphoric ester and like groups, e.g., alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates and the like; amphoteric surface active agents such as amino acids, aminoalkyl sulfonic acids, aminoalkyl sulfates or phosphates, alkylbetaines, amine oxides and the like; and cationic surface active agents such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts; and the like.

The photographic emulsions of the photographic light-sensitive materials of the present invention may contain, for example, polyalkylene oxides and derivatives thereof (e.g., ethers, esters, and amines), thioether compounds, thiomorpholines, quaternary ammonium salt compounds, urethane derivatives, urea derivatives, imidazole derivatives, 3-pyrazolidones and the like for the purposes of increasing sensitivity and contrast or accelerating development.

The photographic emulsion layers and other hydrophilic colloidal layers of photographic light-sensitive materials used in the present invention can contain dispersions of water-insoluble or slightly soluble synthetic polymers for the purpose of improving dimensional stability and the like. Such polymers include those having, as monomer components, alkyl (meth)acrylate, alkoxyalkyl (meth)acrylate, glycidyl (meth)acrylate, (meth)acrylamide, vinyl esters (e.g., vinyl acetate), acrylonitrile, olefins and styrene, individually or in combination of two or more thereof, or a combination of the above-enumerated monomers and acrylic acid, methacrylic acid, an $\alpha,\beta$-unsaturated dicarboxylic acid, a hydroxyalkyl (meth)acrylate, a sulfoalkyl (meth)acrylate, styrenesulfonic acid, etc.

Conventional methods and processing solutions as described, e.g., in *Research Disclosure*, No. 176, pp. 28–30, can be applied to photographic processing of the photographic emulsions prepared in accordance with the present invention. Any photographic processing either for the formation of silver images (monochromatic photographic processings) or for the formation of dye images (color photographic processings) can be used depending on the end use of the light-sensitive material. Processing temperatures are generally selected in the range of from 18° C. to 50° C., but temperatures outside of this range may also be employed.

For fixing, commonly employed fixing solutions can be used. Fixing agents which can be used include thiosulfates and thiocyanates as well as organic sulfur compounds which are known to have a fixing effect. The fixing solution may contain water-soluble aluminum salts as a hardener.

Formation of dye images can be carried out according to known methods, such as the negative-positive method as described in, for example, *Journal of the Society of Motion Picture and Television Engineers*, Vol. 61, pp. 667–701 (1953); the color reversal method comprises developing with a developing solution containing a monochromatic developing agent to form a negative silver image, subjecting the silver image to fogging treatment by at least one uniform exposure to light or any other appropriate fogging treatment and subsequently subjecting the silver image to color development processing to obtain a positive dye image; and the like. From considerations of objects and effects of the present invention, it is particularly preferred that the light-sensitive materials of the present invention are processed by the color reversal method.

Color developing solutions generally comprise an alkaline aqueous solution containing a color developing agent. Examples of the color developing agent include known aromatic primary amine developers, such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

The color developing solution can further contain a pH buffer, such as sulfites, carbonates, borates and phosphates of alkali metals; a development inhibitor or antifoggant, such as bromides, iodides and organic antifoggants. If desired, the color developing solution can additionally contain a water softener, a preservative, e.g., hydroxylamine, an organic solvent, e.g., benzyl alcohol, diethylene glycol, etc., a development accelerator, e.g., polyethylene glycol, quaternary ammonium salts, amines, etc., dye-forming couplers, a competing coupler, a fogging agent, e.g., sodium borohydride, etc., a viscosity-imparting agent, a polycarboxylic acid type chelating agent, an antioxidant, and the like.

Specific examples of these additives are disclosed in *Research Disclosure*, No. 176 (RD-17643), 1978, U.S. Pat. No. 4,083,723, West German Patent Application (OLS) No. 2,622,950, etc.

Monochromatic developing solutions can contain known developing agents, such as dihydroxybenzenes (e.g., hydroquinone), 3-pyrazolidones (e.g., 1-phenyl-3-pyrazolidone) and aminophenols (e.g., N-methyl-p-aminophenol) individually or in combination.

Fogging agents which can be used for the aforesaid fogging treatment can include alkali metal borohydrides, aminoboranes, ethylenediamine, tin salts, especially stannous chloride, as well as those described in Japanese Patent Publication No. 38816/72.

After color development, the photographic emulsion is generally subjected to bleaching. Bleaching may be carried out simultaneously with fixing, or these two processes may be carried out separately. Examples of bleaching agents which can be used include ferricyanides, bichromates, organic complex salts of Fe (III) or Co (III), e.g., those formed by aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.), persulfates, permanganates, nitrosophenol, and the like. Of these, potassium ferricyanide, sodium (ethylenediaminetetraacetato)ferrate (III) and ammonium (ethylenediaminetetraacetato)ferrate (III) are particularly useful. The (ethylenediaminetetraacetato)iron (III) complex salts are useful in both of an independent bleaching solution and a combined bleach-fix solution.

The photographic emulsions used in the present invention may be spectrally sensitized with methine dyes and others. Examples of dyes which can be used include cyanine dyes, merocyanine dyes, complex cyanine dyes, complex merocyanine dyes, holopolar cyanine dyes, hemicyanine dyes, styryl dyes and hemioxonol dyes. Of these, cyanine dyes, merocyanine dyes and complex merocyanine dyes are particularly preferred. Any of nuclei commonly employed for cyanine dyes as basic heterocyclic nuclei can be applied to these dyes. Such heterocyclic nuclei include pyrroline, oxazoline, thiazoline, pyrrole, oxazole, thiazole, selenazole, imidazole, tetrazole and pyridine nuclei, etc.; the above-described nuclei having fused thereon an alicyclic hydrocarbon ring; and the above-described nuclei having fused thereon an aromatic hydrocarbon ring, e.g., indolenine, benzindolenine, indole, benzoxazole, naphthoxazole, benzothiazole, naphthothiazole, benzoselenazole, benzimidazole and quinoline nuclei. These nuclei may be substituted at their carbon atoms.

To merocyanine dyes or complex merocyanine dyes can be applied 5- or 6-membered heterocyclic nuclei having a ketomethylene structure, such as pyrazolon-5-one, thiohydantoin, 2-thiooxazolidine-2,4-dione, thiazolidine-2,4-dione, rhodanine and thiobarbituric acid nuclei, etc.

These sensitizing dyes can be used alone or in combination of two or more of them. A combination of sensitizing dyes is frequently used for the purpose of supersensitization. The photographic emulsions may contain, in combination with the sensitizing dyes, a dye which per se possesses no effect of spectral sensitization or a substance which does not substantially absorb visible light, but both exhibiting supersensitizing effect when used in combination with the sensitizing dyes. Examples of such compounds include aminostyryl compounds substituted by a nitrogen-containing heterocyclic group (e.g., those described in U.S. Pat. Nos. 2,933,390 and 3,635,721), aromatic organic acidformaldehyde condensates (e.g., those described in U.S. Pat. No. 3,743,510), cadmium salts and azaindene compounds. The combinations disclosed in U.S. Pat. Nos. 3,615,613, 3,615,641, 3,617,295 and 3,635,721 are particularly useful.

In the photographic light-sensitive materials per the present invention, the photographic emulsion layers and other hydrophilic colloidal layers may contain inorganic or organic hardeners. Specific examples of the hardeners which can be used include chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) and the like. These hardeners may be used alone or in combinations of two or more thereof.

When the hydrophilic colloidal layers of the photographic light-sensitive materials of the present invention contain dyes or ultraviolet absorbents, they may be mordanted by cationic polymers and the like.

The photographic light-sensitive materials in accordance with the present invention may contain a color fog preventing agent, such as a hydroquinone derivative, an aminophenol derivative, a gallic acid derivative, an ascorbic acid derivative, etc.

The hydrophilic colloidal layers of the photographic light-sensitive materials prepared in accordance with the present invention may contain ultraviolet absorbents. Specific examples of ultraviolet absorbents which can be used include benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic ester compounds (e.g., those described in U.S. Pat. Nos. 3,705,805 and 3,707,375), butadiene compounds (e.g., those described in U.S. Pat. No. 4,045,229) and benzoxazole compounds (e.g., those described in U.S. Pat. No. 3,700,455). Further, the ultraviolet absorbents disclosed in U.S. Pat. No. 3,499,762 and Japanese Patent Application (OPI) No. 48535/79 can also be used. Furthermore, ultraviolet absorbing couplers (e.g., α-naphthol type cyan forming couplers) or ultraviolet absorbing polymers may also be used. These ultraviolet absorbents may be fixed in a specific layer.

Hydrophilic colloidal layers of the photographic light-sensitive materials prepared in accordance with the present invention may contain water-soluble dyes as filter dyes or for various purposes including prevention of irradiation. Such dyes can include oxonol dyes, hemioxonol dyes, styryl dyes, merocyanine dyes, cyanine dyes and azo dyes. Among them, oxonol dyes, hemioxonol dyes and merocyanine dyes are used to greater advantage.

In carrying out the present invention, known discoloration inhibitors can be used and, moreover, color image stabilizing agents may be used individually or as a combination of two or more thereof. Examples of the discoloration inhibitors include hydroquinone derivatives, gallic acid derivatives, p-alkoxyphenol derivatives, p-oxyphenol derivatives, bisphenols and the like.

The present invention will now be illustrated in greater detail with reference to specific examples, but it should be understood that these examples are not limiting the present invention. In these examples, all percents are by weight unless otherwise indicated.

EXAMPLE 1

The following layers were coated on a triacetate film support in the order given below to prepare a color reversal photographic light-sensitive material.

First Layer (Antihalation Layer):

A gelatin layer containing black colloidal silver.

Second Layer (Intermediate Layer):

2,5-Di-t-octylhydroquinone was dissolved in 100 ml of dibutyl phthalate and 100 ml of ethyl acetate, and the solution was mixed with 1 kg of a 10% aqueous solution of gelatin under high speed stirring to prepare 2 kg of an emulsion. The resulting emulsion and 1 kg of a fine grain emulsion (grain size: 0.06 μm; 1 mol % silver iodobromide emulsion) which had not been chemically sensitized were mixed with 1.5 kg of a 10% aqueous solution of gelatin, and the composition was coated on the first layer to form a layer having a dry thickness of 2 μm (silver coverage: 0.4 g/m$^2$).

Third Layer (Low-Sensitivity Red-Sensitive Emulsion Layer):

100 g of a cyan coupler, 2-(heptafluorobutaneamido)-5-[2′-(2″,4″-di-t-aminophenoxy)butaneamido]phenol, was dissolved in 100 ml of tricresyl phosphate and 100 ml of ethyl acetate, and the solution was stirred with 1 kg of a 10% gelatin aqueous solution at high speed to prepare 500 g of an emulsion. The emulsion was mixed with 1 kg of a red-sensitive silver iodobromide emulsion (iodine content: 6 mol %) containing 70 g of silver and 60 g of gelatin and coated on the second layer to form a layer having a dry thickness of 1 μm (silver coverage: 0.5 g/m$^2$).

Fourth Layer (High Sensitivity Red-Sensitive Emulsion Layer:

100 g of a cyan coupler, 2-(heptafluorobutaneamido)-5-[2′-(2″,4″-di-t-aminophenoxy)butaneamido]phenol, was dissolved in 100 ml of tricresyl phosphate and 100 ml of ethyl acetate, and the solution was stirred with 1 kg of a 10% gelatin aqueous solution at high speed to prepare 1,000 g of an emulsion. The resulting emulsion was mixed with 1 kg of a red-sensitive silver iodobromide emulsion (iodine content: 6 mol %) containing 70 g of silver and 60 g of gelatin, and the mixture was coated on the third layer to form a layer having a dry thickness of 2.5 μm (silver coverage: 0.8 g/m$^2$).

Fifth Layer (Intermediate Layer):

2,5-Di-t-octylhydroquinone was dissolved in 100 ml of dibutyl phthalate and 100 ml of ethyl acetate, and the solution was mixed with 1 kg of a 10% aqueous solution of gelatin at a high speed to obtain 1 kg of an emulsion. The resulting emulsion was mixed with 1 kg of a 10% aqueous solution of gelatin, and the composition was coated to form a layer having a dry thickness of 1 μm.

Sixth Layer (Low-Sensitivity Green-Sensitive Emulsion Layer):

In the same manner as for the third layer except for using a magenta coupler, 1-(2,4,6-trichlorophenyl)-3-[3-(2,4-di-t-amylphenoxyacetamido)benzamido]-5-pyrazolone, in place of the cyan coupler, 300 g of an emulsion was prepared. The resulting emulsion was mixed with 1 kg of a green-sensitive silver iodobromide emulsion (iodine content: 7 mol %) containing 70 g of silver and 60 g of gelatin, and the composition was coated to form a layer having a dry thickness of 1.3 μm (silver coverage: 0.75 g/m$^2$).

Seventh Layer (High Sensitivity Green-Sensitive Emulsion Layer):

1,000 g of an emulsion was prepared in the same manner as for the third layer except for using a magenta coupler, 1-(2,4,6-trichlorophenyl)-3-[3-(2,4-di-t-amylphenoxyacetamido)benzamido]-5-pyrazolone, in place of the cyan coupler. The resulting emulsion was mixed with 1 kg of a green-sensitive silver iodobromide emulsion (iodine content: 6 mol %) containing 70 g of silver and 60 g of gelatin, and the composition was coated to form a layer having a dry thickness of 3.5 μm (silver coverage: 1.1 g/m$^2$)

Eighth Layer (Yellow Filter Layer):

An emulsion containing yellow colloidal silver was coated to form a layer having a dry thickness of 1 μm.

Ninth Layer (Low Sensitivity Blue-Sensitive Emulsion Layer):

1,000 g of an emulsion was prepared in the same manner as for the first layer except for using a yellow coupler, α-(pivaloyl)-α-(1-benzyl-5-ethoxy-3-hydantoinyl)-2-chloro-5-dodecyloxycarbonylacetanilide, in place of the cyan coupler. The resulting emulsion was mixed with 1 kg of a blue-sensitive silver iodobromide emulsion (iodine content: 7 mol %) containing 70 g of silver and 60 g of gelatin, and the composition was coated to form a layer having a dry thickness of 1.5 μm (silver coverage: 0.4 g/m$^2$).

Tenth Layer (High Sensitivity Blue-Sensitive Emulsion Layer):

1,000 g of an emulsion was prepared in the same manner as for the emulsion of the first layer except for using a yellow coupler, α-(pivaloyl)-α-(1-benzyl-5-ethoxy-3-hydantoinyl)-2-chloro-5-dodecyloxycarbonylacetanilide, in place of the cyan coupler. The resulting emulsion was mixed with 1 kg of a blue-sensitive silver iodobromide emulsion (iodine content: 6 mol %) containing 70 g of silver and 60 g of gelatin, and the composition was coated to form a layer having a dry thickness of 3 μm (silver coverage: 0.8 g/m$^2$).

Eleventh Layer (Second Protecting Layer):

15 g of 5-chloro-2-(2-hydroxy-3,5-di-t-butylphenyl)-2H-benzotriazole, 30 g or 2-(2-hydroxy-5-t-butylphenyl)-2H-benzotriazole, 35 g of 2-(2-hydroxy-3-sec-butyl-5-t-butylphenyl)-2H-benzotriazole and 100 g of 5-(N,N-diethylamino)-2-benzenesulfonyl-2,4-pentadienoate as ultraviolet absorbents, 200 ml of tricresyl phosphate, 200 ml of ethyl acetate, 20 g of sodium dodecylbenzenesulfonate and a 10% gelatin aqueous solution were stirred at high speed to prepare an emulsion. The resulting emulsion was then mixed with a 10% gelatin aqueous solution, water and a coating aid, and the mixture was coated in a dry thickness of 2 μm.

Twelfth Layer (First Protecting Layer):

A 10% gelatin aqueous solution containing a fine grain emulsion having the surfaces of grains fogged (grain size: 0.06 μm; 1 mol % silver iodobromide emulsion) was coated to form a layer having a silver coverage of 0.1 g/m$^2$ and a dry thickness of 0.8 μm.

The thus-prepared sample was designated as Sample 101.

Samples 102 and 103 were prepared in the same manner as for Sample 101 except that an intermediate layer comprising gelatin and having a film thickness shown in Table 1 was provided between the sixth layer (i.e., the low sensitivity green-sensitive emulsion layer) and the seventh layer (i.e., the high sensitivity green-sensitive emulsion layer) and that the amount of the low sensitivity green-sensitive emulsion layer to be coated was increased to adjust the sensitivity and the maximum density to those of Sample 101.

Each of the resulting samples was exposed to white light through a sensitometric optical wedge at an illuminance of 1,000 lux at an exposed surface using a light source of 4,800K, and subsequently subjected to the following development processing to obtain a dye image.

Development Processing

| Process | Time (min) | Temperature (°C.) |
|---|---|---|
| First Development | 6 | 38 |
| Rinsing | 2 | " |
| Reversal | 2 | " |
| Color Development | 6 | " |
| Adjustment | 2 | " |
| Bleaching | 6 | " |
| Fixing | 4 | " |
| Rinsing | 4 | " |
| Stabilization | 1 | Room Temperature |
| Drying | | |

| First Developing Solution | |
|---|---|
| Water | 700 ml |
| Sodium Tetrapolyphosphate | 2 g |
| Sodium Sulfite | 20 g |
| Potassium 2,5-dihydroxybenzenesulfonate | 30 g |
| Sodium Carbonate Monohydrate | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |

| Reversal Solution | |
|---|---|
| Water | 700 ml |
| Hexasodium Nitrilo-N,N,N—trimethylenephosphonate | 3 g |
| Stannous Chloride Dihydrate | 1 g |
| p-Aminophenol | |
| Sodium Hydroxide | 8 g |
| Glacial Acetic Acid | 15 ml |
| Water to make | 1,000 ml |

| Color Developing Solution | |
|---|---|
| Water | 700 ml |
| Sodium Tetrapolyphosphate | 2 g |
| Sodium Sulfite | 7 g |
| Sodium Phosphate Dodecahydrate | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl N—(β-methanesulfonamidoethyl)-3-methyl-4-aminoaniline Sulfate | 11 g |
| Ethylenediamine | 3 g |
| Water to make | 1,000 ml |

| Adjusting Solution | |
|---|---|
| Water | 700 ml |
| Sodium Sulfite | 12 g |
| Sodium Ethylenediaminetetraacetate Dihydrate | 8 g |
| Thioglycerin | 0.4 ml |
| Glacial Acetic Acid | 3 ml |
| Water to make | 1,000 ml |

| Bleaching Solution | |
|---|---|
| Water | 800 ml |
| Sodium Ethylenediaminetetraacetate Dihydrate | 2.0 g |

-continued

| | |
|---|---|
| Ammonium (Ethylenediaminetetra-acetato)ferrate (III) Dihydrate | 120.0 g |
| Potassium Bromide | 100.0 g |
| Water to make | 1,000 ml |
| Fixing Solution | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution | |
| Water | 800 ml |
| Formalin (37 wt % formaldehyde solution) | 5.0 ml |
| Fuji Driwel (surface active agent, a product of Fuji Photo Film Co., Ltd.) | |
| Water to make | 1,000 ml |

The optical density of the magenta image formed on each of the samples was determined through a green filter by the use of a microdensitometer. Graininess (RMS value) was determined by the method described, for example, in *Photographic Science and Engineering*, Vol. 4, pp. 235–238 (1975) and D. Zwick and B. L. Brothers, Jr., *RMS Granularity: Determination of Just-noticeable Difference*, and represented by a value 1,000 times the standard deviation of variation in density which is effected by scanning by the microdensitometer.

Further, each sample was subjected to the same procedures as described above except for using a sensitometric wedge instead of the sensitometric optical wedge, and the optical density of the magenta image formed was determined through a green filter. Sensitivity was represented by the reciprocal of a dose of exposure required for obtaining a constant magenta density (D=1.0).

The results obtained are shown in Table 1.

TABLE 1

| Sample No. | Thickness of Intermediate Layer (μm) | Specific Sensitivity D = 1.0 | Maximum Density | Graininess D = 0.5 | Graininess D = 1.0 |
|---|---|---|---|---|---|
| 101 | — | 100 | 3.02 | 15.8 | 22.3 |
| 102 | 0.47 | 100 | 2.98 | 11.5 | 17.8 |
| 103 | 0.94 | 120 | 2.95 | 9.8 | 17.5 |

It can be seen from Table 1 that the samples having a gelatin intermediate layer between a high sensitivity emulsion layer and a low sensitivity emulsion layer exhibit excellent graininess while showing sensitivities and maximum densities substantially equal to those obtained by the sample having no intermediate layer.

EXAMPLE 2

Samples 201 to 204 were prepared in the same manner as described in Example 1 except that the amount of the emulsion in the seventh layer of Sample 101 was adjusted that the high sensitivity green-sensitive emulsion layer had a silver to coupler molar ratio of 5; the amount of the emulsion in the sixth layer was so adjusted that the low sensitivity green-sensitive emulsion layer had a silver to coupler molar ratio as indicated in Table 2; and each of the high sensitivity and low sensitivity green-sensitive emulsion layers was coated so as to result in a silver coverage of 0.45 g/m$^2$.

Samples 205 to 208 were prepared in the same manner as for Samples 201 to 204 except that an intermediate layer comprising gelatin was formed having a dry thickness of 0.94 μm between the low sensitivity green-sensitive emulsion layer and the high sensitivity green-sensitive emulsion layer.

Each of the thus-prepared samples was exposed to light and developed, and the graininess was evaluated in the same manner as in Example 1. The results obtained are shown in Table 2.

TABLE 2

| Sample No. | Low Sensitivity Green-Sensitive Layer: Silver Coverage (g/m$^2$) | Low Sensitivity Green-Sensitive Layer: Silver/Coupler Molar Ratio | High Sensitivity Green-Sensitive Layer: Silver Coverage (g/m$^2$) | High Sensitivity Green-Sensitive Layer: Silver/Coupler Molar Ratio | Thickness of Intermediate Layer (μm) | Specific Sensitivity D = 1.0 | Maximum Density | Graininess D = 0.5 | Graininess D = 1.0 |
|---|---|---|---|---|---|---|---|---|---|
| 201 | 0.45 | 5.0 | 0.45 | 5.0 | — | 100 | 2.58 | 18.2 | 28.4 |
| 202 | " | 7.5 | " | " | — | 107 | 2.44 | 17.6 | 27.0 |
| 203 | " | 10.0 | " | " | — | 117 | 2.32 | 17.4 | 26.9 |
| 204 | " | 20.0 | " | " | — | 135 | 2.16 | 15.5 | 23.9 |
| 205 | " | 5.0 | " | " | 0.94 | 105 | 2.55 | 17.6 | 27.2 |
| 206 | " | 7.5 | " | " | " | 115 | 2.34 | 16.9 | 25.1 |
| 207 | " | 10.0 | " | " | " | 138 | 2.18 | 15.9 | 23.4 |
| 208 | " | 20.0 | " | " | " | 186 | 1.80 | 13.7 | 22.4 |

It can be seen from Table 2 that when graininess was compared between two samples having the same silver to coupler molar ratio in the low sensitivity green-sensitive emulsion layer, one of which had a gelatin intermediate layer and another of which had no gelatin intermediate layer, the sample having the gelatin intermediate layer showed better graininess in the practically important low density portions. Further, when graininess was compared between Samples 203 and 206 being substantially equal in terms of specific sensitivity and maximum density, Sample 206 wherein an intermediate layer comprising gelatin was provided had better graininess in spite of its smaller silver to coupler molar ratio of the low sensitivity green-sensitive emulsion layer. These results indicate that an effect of improving graininess can be produced by providing a gelatin intermediate layer.

While the invention has been described in detail and with reference to specific embodiments thereof, it will be apparent to one skilled in the art that various changes and modifications can be made therein without departing from the spirit and scope thereof.

What is claimed is:

1. A silver halide color light-sensitive material comprising a support having provided thereon at least two emulsion layers, each comprising at least one coupler, that are sensitive to the same color light but have different sensitivities, wherein a light-insensitive intermediate layer comprising gelatin is provided between any two of said emulsion layers that are adjacent to each other, and the higher sensitivity emulsion layer of said two emulsion layers has a smaller silver/coupler molar ratio than that of the lower sensitivity emulsion layer of said two emulsion layers.

2. A silver halide color light-sensitive material as in claim 1, wherein the light-insensitive intermediate layer has a thickness of at least 0.1 μm.

3. A silver halide color light-sensitive material as in claim 2, wherein the light-insensitive intermediate layer has a thickness of from 0.1 to 3 μm.

4. A silver halide color light-sensitive material as in claim 3, wherein the light-insensitive intermediate layer has a thickness of from 0.3 to 1.5 μm.

5. A silver halide color light-sensitive material as in claim 1, wherein the lower sensitivity emulsion layer has a silver/coupler molar ratio greater than that of the higher sensitivity emulsion layer by a factor of 1.2 or more.

6. A silver halide color light-sensitive material as in claim 5, wherein the lower sensitivity emulsion layer has a silver/coupler molar ratio greater than that of the higher sensitivity emulsion layer by a factor of 1.4 or more.

7. A silver halide color light-sensitive material as in claim 1, wherein the higher sensitivity emulsion layer has a silver/coupler molar ratio of from 2/1 to 20/1.

8. A silver halide color light-sensitive material as in claim 7, wherein the higher sensitivity emulsion layer has a silver/coupler molar ratio of from 4/1 to 15/1.

9. A silver halide color light-sensitive material as in claim 1, wherein the lower sensitivity emulsion layer has a silver/coupler molar ratio of 4/1 or more.

10. A silver halide color light-sensitive material as in claim 9, wherein the lower sensitivity emulsion layer has a silver/coupler molar ratio of from 8/1 to 100/1.

11. A silver halide color light-sensitive material as in claim 3, wherein the lower sensitivity emulsion layer has a silver/coupler molar ratio greater than that of the higher sensitivity emulsion layer by a factor of 1.2 or more.

12. A silver halide color light-sensitive material as in claim 3, wherein the lower sensitivity emulsion layer has a silver/coupler molar ratio greater than that of the higher sensitivity emulsion layer by a factor of 1.4 or more.

13. A silver halide color light-sensitive material as in claim 11, wherein the higher sensitivity emulsion layer has a silver/coupler molar ratio of from 2/1 to 20/1.

14. A silver halide color light-sensitive material as in claim 13, wherein the higher sensitivity emulsion layer has a silver/coupler molar ratio of from 4/1 to 15/1.

15. A silver halide color light-sensitive material as in claim 11, wherein the lower sensitivity emulsion layer has a silver/coupler molar ratio of 4/1 or more.

16. A silver halide color light-sensitive material as in claim 15, wherein the lower sensitivity emulsion layer has a silver/coupler molar ratio of from 8/1 to 100/1.

17. A silver halide color light-sensitive material as in claim 13, wherein the lower sensitivity emulsion layer has a silver/coupler molar ratio of 4/1 or more.

18. A silver halide color light-sensitive material as in claim 13, wherein the lower sensitivity emulsion layer has a silver/coupler molar ratio of from 8/1 to 100/1.

19. A silver halide color light-sensitive material as in claim 14, wherein the lower sensitivity emulsion layer has a silver/coupler molar ratio of from 8/1 to 100/1.

* * * * *